United States Patent [19]

Fricker

[11] 4,104,992

[45] Aug. 8, 1978

[54] INJECTION INSTALLATION FOR INTERNAL COMBUSTION ENGINES

[75] Inventor: Ludwig Fricker, Stuttgart, Germany

[73] Assignee: Daimler-Benz Aktiengesellschaft, Germany

[21] Appl. No.: 749,806

[22] Filed: Dec. 13, 1976

[30] Foreign Application Priority Data

Dec. 13, 1975 [DE] Fed. Rep. of Germany ..... 2556214

[51] Int. Cl.[2] ..... F02B 3/00; F02B 3/04

[52] U.S. Cl. ..... 123/32 JV; 123/32 JT; 123/139 AK; 123/139 AT

[58] Field of Search ..... 239/289, 87, 553, 533; 123/139 AK, 139 AT, 32 JV, 32 JT, 32 ST, 32 SP

[56] References Cited

U.S. PATENT DOCUMENTS

| | | | |
|---|---|---|---|
| 1,982,023 | 11/1934 | Ritz | 123/139 AK |
| 2,729,169 | 1/1956 | Nichols | 123/139 AT |
| 3,587,547 | 6/1971 | Hussey et al. | 123/32 AE |
| 3,737,100 | 6/1973 | Dreisin | 123/139 AK |
| 3,980,058 | 9/1976 | Nakagawa et al. | 123/32 AE |
| 4,036,195 | 7/1977 | Bailey | 123/139 AK |

*Primary Examiner*—Charles J. Myhre
*Assistant Examiner*—R. A. Nelli
*Attorney, Agent, or Firm*—Craig & Antonelli

[57] ABSTRACT

An injection installation for internal combustion engines, especially for mixture-compressing internal combustion engines operating with charge stratification, which essentially consists of an injection pump and of injection valves coordinated to the cylinders of the internal combustion engine; a metering mechanism is thereby arranged in each injection valve which with a feed of the injection pump supplies a metered quantity of fuel to the nozzle discharge of the injection valve while the injection pump is so constructed that it always supplies a multiple of the metered quantity of fuel independently of load and rotational speed of the internal combustion engine whereby the excess quantity of fuel flows back into the fuel tank by way of a return line connected to the injection valve.

21 Claims, 2 Drawing Figures

INJECTION INSTALLATION FOR INTERNAL COMBUSTION ENGINES

Figure 1:
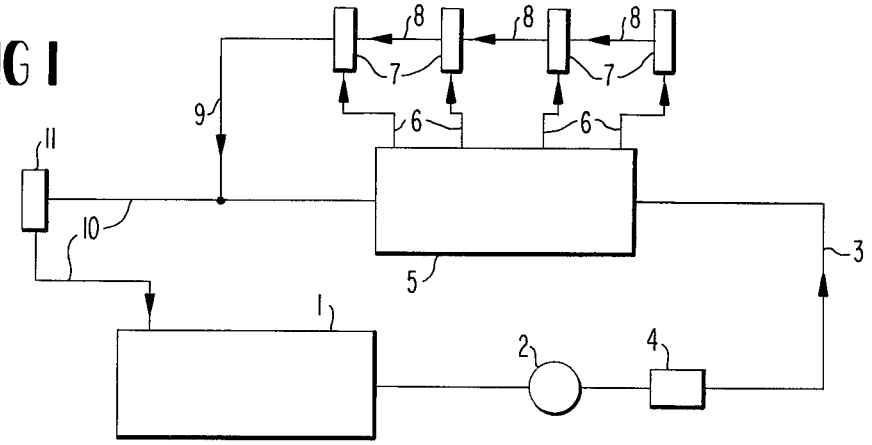

The present invention relates to an injection installation for internal combustion engines, especially for mixture-compressing internal combustion engines operating with charge stratification, which essentially consists of an injection pump and of injection valves coordinated to the cylinders of the internal combustion engine.

With customary injection systems, the injection quantity is metered in the injection pump and is injected into the combustion space by way of the injection valve. For very small injection quantities per cylinder of the internal combustion engine which are, for example of the order of magnitude between 0.5 and 3 mm.$^3$ per working cycle, an accurate metering in the injection pump becomes problematical. Additionally, the quantity deviations which result from the expansion of the injection lines and from harmful spaces present from the injection pump to the injection valve, become proportionately larger in relation to a small overall quantity. The greatest disadvantageous consequences, however, result for the injection valve itself because it is only inadequately cooled by the feed of very small fuel quantities.

The present invention, in contrast thereto, is concerned with the task to provide an injection system in which always a constant quantity of fuel, and more particularly, a very small quantity can be injected out of each injection valve. Very small constant quantities of fuel are required, for example, in internal combustion engines with charge stratification for the second fuel feed. Additionally, it is the aim of the present invention to effect a sufficient cooling of the injection valve.

According to the present invention, the underlying problems are solved in that a metering mechanism is arranged in each injection valve which with a feed of the injection pump, supplies a metered quantity of fuel, preferably a small quantity, to the nozzle discharge, and in that the injection pump is so constructed that it always supplies a multiple of the metered quantity of fuel independently of load and rotational speed, which flows back into the fuel tank by way of a return line connected to the injection valve.

As a result of the arrangement of a metering mechanism in the injection valve itself, a very accurate metering of smallest quantities is feasible. An excellent cooling of the injection valve thereby takes place because the injection pump feeds a multiple of the required fuel, for example, 10 to 20 times the quantity of fuel.

In an advantageous construction of the inventive subject matter, the metering mechanism in the injection valve may consist of a piston arranged in a cylinder space and displaceable against spring pressure in the injection direction by the feed pressure of the injection pump between two abutments and of a valve which with an absent feed of the injection pump keeps open a connection between the inlet of the injection valve and the cylinder space underneath the piston and to the return line, whereas in case of a feed of the injection pump it closes the connection between the inlet and the cylinder space. The piston is braked from full speed to zero by the abutment control for the piston provided in accordance with the present invention. This produces an injection characteristic in which one operates in the rising portion of a sinusoidal curve, so that an after-injection of the nozzle is avoided advantageously.

The cylinder space of the metering mechanism can be arranged structurally favorably in a coaxial manner above the space accommodating the nozzle needle of the injection valve and the valve constructed as valve disk may be arranged above the piston provided in this cylinder space, which valve controls openings in the bottom of the piston.

The valve may be displaceably supported in a structurally and operationally favorable manner relative to the piston centrally within the piston by means of a bolt and a disk forming an abutment for the valve may be secured underneath the bottom of the piston at the bolt, against which is supported the compression spring pressing the piston against the upper abutment.

The upper abutment may be formed by projections at an adjusting sleeve screwed into the injection valve and adapted to be readjusted whereby these projections overlap the outer edge of the valve disk of the valve.

The openings in the bottom of the piston may consist of bores which abut at the piston inside of a ring-shaped valve seating surface.

The discharge of excessive fuel can take place by way of bores provided laterally of the valve disk into an annular space of large axial extent which is arranged between the clamping sleeve and the nozzle holder of the injection valve and a bore provided in the nozzle holder may connect this annular space with the return line.

Accordingly, it is an object of the present invention to provide an injection system for internal combustion engines which avoids by simple means the aforementioned shortcomings and drawbacks encountered in the prior art.

Another object of the present invention resides in an injection installation for an internal combustion engine by means of which smallest quantities of fuel can be accurately metered and injected into the combustion space.

A further object of the present invention resides in an injection installation for internal combustion engines in which quantity deviations in the injected quantities are substantially eliminated, even in case of relatively minute injection quantities.

A further object of the present invention resides in an injection installation for internal combustion engines which assures a sufficient cooling of the injection valve even in the presence of relatively small quantities of injected fuel.

Another object of the present invention resides in an injection system for internal combustion engines in which a very accurate metering of smallest quantities is realizable in the injection valve itself without danger of insufficient cooling of the valve.

Another object of the present invention resides in an injection installation of the type described above which is favorable from a structural and operating point of view and which is relatively compact in structure.

A further object of the present invention resides in an injection system of the type described above which not only achieves all of the aforementioned aims and objects but additionally effectively precludes an after-injection through the injection nozzle.

Figure 2:
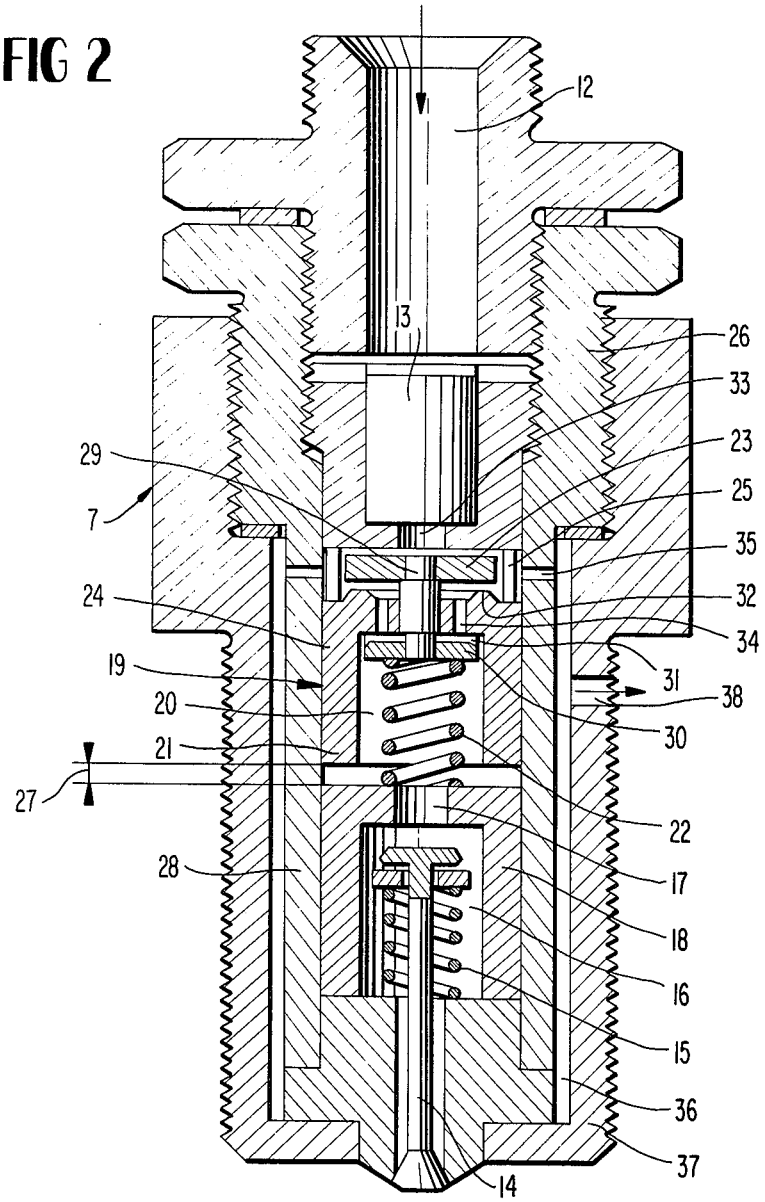

These and other objects, features and advantages of the present invention will become more apparent from the following description when taken in connection with the accompanying drawing which shows, for purposes of illustration only, one embodiment in accordance with the present invention, and wherein:

FIG. 1 is a schematic diagram of the overall arrangement of an injection installation in accordance with the present invention; and FIG. 2 is a longitudinal cross-section view through an injection valve with a metering mechanism in accordance with the present invention.

Referring now to the drawing wherein like reference numerals are used throughout the two views to designate like parts, according to FIG. 1, fuel is sucked-in out of a tank 1 by means of a feed pump 2 and is fed to an injection pump 5 by way of a line 3, into which is interconnected a filter 4. From the injection pump 5 fuel is fed to the injection valves 7 by way of injection lines 6, whereby the fuel is injected out of the injection valves 7 into the combustion spaces of an internal combustion engine (not shown). The injection valves 7 are connected with each other by way of return lines 8, by means of which non-injected fuel is fed to the common return line 9. The common line 9 is connected with a line 10 leading from the injection pump 5 to the tank 1, through which an excess quantity of fuel which had been fed to the injection pump 5 flows back to the tank 1, and more particularly pressure-relieved by the pressure control member 11 arranged in the line 10. A metering mechanism is arranged in the injection valves 7 which permits to inject very small quantities of fuel per cylinder of the internal combustion engine. The injection pump 5 is so constructed and designed that it serves only as supplier of a non-controlled fuel quantity which arrives at the correct instant in the injection valves 7. The actual quantity (of fuel delivered to the injection valve 7 by the injection pump 5) may vary over the load and rotational speed of the internal combustion engine but, in each case, the actual delivered quantity is a multiple of the (metered quantity of fuel injected by the injection valve 7).

As can be seen more clearly from FIG. 2, a metering mechanism generally designated by reference numeral 19 is arranged in the injection valve 7 between the inlet 12, to which will be connected the injection line, with a filter 13 connected downstream thereof, and the space 16 accommodating the valve needle 14 with a compression spring 15, which space 16 is covered off by an abutment sleeve 18 provided with a bore 17 in the upward direction. The metering mechanism 19 essentially consists of a piston 21 arranged in the cylinder space 20, of a compression spring 22 and of a valve 23 constructed as disk or plate valve, which is disposed above the bottom 24 of the piston 21. The piston 21 is pressed by the compression spring 22 from the abutment sleeve 18 against projections 25, which are arranged at an adjusting sleeve 26 receiving the filter 13 and which overlap the valve 23 in such a manner that a gap 27 results in the cylinder space 20 between the abutment sleeve 18 and the piston 21. The volume of this gap, less a portion of the volume of the compression spring 22 determines the fuel quantity injected by the injection valve. The height of the gap 27 can be adjusted by means of the adjusting sleeve 26, which is screwed into the clamping sleeve 28 of the injection valve.

The valve 23 is secured at a bolt 29 which is axially movably supported centrally in the bottom 24 of the piston 21. A disk 30 with radial slots 31 is secured at the bolt 29 underneath the bottom 24 of the piston 21. The compression spring 22 presses the disk 30 against the piston 21 so that the piston 21 abuts at the projections 25. At the same time, the disk 30 keeps by way of the bolt 29 the valve 23 away from a ring-shaped valve seating surface 32 arranged at the bottom 24 of the piston 21 in such a manner that a small gap is also present above the valve 23 to the adjusting sleeve 26 with the through-bore 33.

Several axial bores 34 are provided inside of the valve seating surface 32 within the bottom 24 of the piston 21 so that the fuel can reach the cylinder space 20 out of the inlet 12 by way of the filter 13 and the throughbore 33 around the valve 23 and through the bores 34 and the slots 31.

Radial bores 35 are provided in the clamping sleeve 28 laterally of the projections 25, through which the excess fuel can reach into an annular gap 36 which is arranged in large axial extent between the clamping sleeve 28 and the nozzle holder 37 of the injection valve. One or several bores 38 lead out of the annular gap 36 radially outwardly through the nozzle holder 37, where a return line is connected.

The quantity of fuel fed from the injection pump 5 (FIG. 1) to the injection valve 7, which amounts to a multiple of the required quantity, presses the valve 23 against the valve-seating surface 32 at the piston 21. At this instant the cylinder space 20 underneath the piston 21 is closed off from any fuel supply and the piston 21 and the valve 23 move as a unit against the abutment sleeve 18. As a result thereof, fuel is displaced in the volume of the gap 27, it opens the valve needle 14 and the fuel is injected. At the same time, the excess quantity of fuel flows through the bores 35 into the annular gap 36, cools thereat the injection valve and escapes then through the bore 38 out of the injection valve. After the decrease of the pressure peak in the fuel up to the pressure level in the fuel return line, the nozzle needle 14 closes and the piston 21 and the valve 23 assume the illustrated starting position with the aid of the compression spring 22. Fuel reaches the cylinder space 16 underneath the piston 21 past the valve 23. The injection valve is now operationally ready for the next operating cycle.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An injection installation for internal combustion engines, comprising injection pump means and injection valve means coordinated to the cylinders of the internal combustion engine, characterized in that a metering means is arranged in each injection valve means which is operable with a feed of the injection pump means, to feed a metered quantity of fuel to the nozzle discharge of the injection valve means, the injection pump means being so constructed that it always feeds a multiple of the metered quantity of fuel independently of load and rotational speed of the internal combustion engine, the excess quantity of fuel, thus fed from the injection pump means, being discharged back to a fuel tank adapted to be connected to the injection valve means by way of a return line.

2. An installation according to claim 1, characterized in that the internal combustion engine is a mixture-compressing internal combustion engine operating with charge stratification.

3. An installation according to claim 1, characterized in that the metering means in the injection valve means includes a piston means arranged in a cylinder space and displaceable against a spring-pressure in an injection direction by the feed pressure of the injection pump means between an upper and a lower abutment means, and a valve means which with an absent feed of the injection pump means, keeps open a connection between an inlet of the injection valve means and the cylinder space underneath the piston means and to a return line connection whereas it closes the connection between the inlet and the cylinder space with a feed of the injection pump means.

4. An installation according to claim 3, characterized in that the injection valve means includes a nozzle needle, the cylinder space of the metering means being arranged substantially coaxially above a space of the injection valve means accommodating the nozzle needle, said valve means being arranged above the piston means provided in the cylinder space, said piston means being provided with aperture means in the bottom thereof and said valve means controlling said aperture means.

5. An installation according to claim 4, characterized in that said valve means is constructed as valve disk.

6. An installation according to claim 4, characterized in that the valve means is displaceably supported substantially centrally in the piston means relative to the latter by means of a bolt, and in that a disk means forming an abutment means for the valve means is secured at the bolt underneath the bottom of the piston means, and a spring means pressing the piston means against the upper abutment means and being supported against said disk means.

7. An installation according to claim 6, characterized in that said spring means is a compression spring.

8. An installation according to claim 6, characterized in that the upper abutment means is formed by projections at an adjusting sleeve means, said projections overlapping an outer edge of the valve disk means of the valve means.

9. An installation according to claim 8, characterized in that the adjusting sleeve means is screwed into the injection valve and is adjustable.

10. An installation according to claim 9, characterized in that the aperture means in the bottom of the piston means consist of bores which are disposed inside a ring-shaped valve seat surface at the piston means.

11. An installation according to claim 10, characterized in that the injection valve means includes a clamping sleeve means and a nozzle holder means, the discharge of excessive fuel taking place by way of bore means provided laterally of the valve means into an annular space arranged between the clamping sleeve means and the nozzle holder means.

12. An installation according to claim 11, characterized in that said last-mentioned annular space has a relatively large axial extension.

13. An installation according to claim 12, characterized in that a bore is provided in the nozzle holder means operable to connect said annular space with a return line connecting means.

14. An installation according to claim 1, characterized in that the injection valve means includes a nozzle needle, a cylinder space of the metering means being arranged substantially coaxially above a space of the injection valve means accommodating a nozzle needle, and a valve means arranged above a piston means provided in the cylinder space, said piston means being displaceable between an upper and lower abutment means and being provided with aperture means in the bottom thereof, and in that said valve means control said aperture means.

15. An installation according to claim 14, characterized in that the valve means is displaceably supported substantially centrally in the piston means relative to the latter by means of a bolt, and in that a disk means forming an abutment means for the valve means is secured at the bolt underneath the bottom of the piston means, and a spring means pressing the piston means against the upper abutment means and being supported against said disk means.

16. An installation according to claim 15, characterized in that an upper abutment means is formed by projections at an adjusting sleeve means, said projections overlapping the outer edge of the valve disk means of the valve means.

17. An installation according to claim 16, characterized in that the adjusting sleeve means is screwed into the injection valve and is adjustable.

18. An installation according to claim 14, characterized in that the aperture means in the bottom of the piston means consist of bores which are disposed inside a ring-shaped valve seat surface at the piston means.

19. An installation according to claim 1, characterized in that the injection valve means includes a clamping sleeve means and a nozzle holder means, the discharge of excessive fuel taking place by way of bore means provided laterally of a valve means into an annular space arranged between the clamping sleeve means and the nozzle holder means.

20. An installation according to claim 19, characterized in that said last-mentioned annular space has a relatively large axial extension.

21. An installation according to claim 19, characterized in that a bore is provided in the nozzle holder means operable to connect said annular space with a return line connecting means.

* * * * *